US006942742B2

(12) United States Patent
Yamagishi

(10) Patent No.: US 6,942,742 B2
(45) **Date of Patent: *Sep. 13, 2005**

(54) COPPER-BASED ALLOY EXCELLENT IN DEZINCING RESISTANCE

(75) Inventor: Yoshinori Yamagishi, Tokyo (JP)

(73) Assignee: Dowa Mining Co., Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/694,792

(22) Filed: Oct. 29, 2003

(65) Prior Publication Data

US 2004/0159375 A1 Aug. 19, 2004

(30) Foreign Application Priority Data

Feb. 13, 2003 (JP) ..... 2003-35044

(51) Int. Cl.[7] ..... C22C 9/04; C22F 1/08
(52) U.S. Cl. ..... 148/433; 420/476
(58) Field of Search ..... 148/433; 420/476

(56) References Cited

FOREIGN PATENT DOCUMENTS

| | | |
|---|---|---|
| JP | 54-135618 | 10/1979 |
| JP | 07310133 | * 11/1995 |
| JP | 10-183275 | 7/1998 |
| JP | 2000-119774 | 4/2000 |
| JP | 2002-3967 | 1/2002 |
| JP | 2002-12927 | 1/2002 |

OTHER PUBLICATIONS (Above JP 07310133 is provided with machine translation).*

* cited by examiner

*Primary Examiner*—Sikyin Ip
(74) *Attorney, Agent, or Firm*—Clark & Brody

(57) ABSTRACT

A copper-based alloy excellent in dezincing resistance comprises, in percentage by weight, Cu: 57–69%, Sn: 0.3–3%, Si: 0.02–1.5%, Bi: 0.5–3%, and Pb: not more than 0.2%, where the ratio of Si/Sn expressed in weight percentage is in the range of 0.05–1 and apparent zinc content as defined by the following formula is in the range of more than 39–50 wt. %, and the balance of unavoidable impurities: Apparent Zn content=[(Zn %+2.0×Sn %+10.0×Si %)/(Cu %+Zn %+2.0×Sn %+10.0×Si %)]×100. Despite the fact that contains no added environment-unfriendly Pb, the alloy exhibits enhanced cuttability, together with excellent forgeability, dezincing resistance and hot forgeability.

4 Claims, No Drawings

COPPER-BASED ALLOY EXCELLENT IN DEZINCING RESISTANCE

BACKGROUND OF THE INVENTION

1. Field of the Invention

This invention relates a copper-based alloy that contains no environment-unfriendly Pb, has excellent corrosion resistance against dezincing corrosion even when used in the presence of a corrosive aqueous solution, and is excellent in hot workability and cuttability.

2. Background Art

Among copper-based alloys, the Cu—Zn alloys (brasses) have long been widely used for plumbing equipment, gas valves and the like because of their excellent hot workability, cuttability and the like. Known types include brass for forging (JIS C 3771), free-cutting brass (JIS C 3604) and high-strength brass (JIS C 6782), but all of these copper-based alloys contain large amounts of lead, which is known to be unfriendly to the environment.

These alloys are also characterized by very inferior dezincing resistance, particularly in an environment where corrosive aqueous solution is present, because of its preferential elution owing the strong ionization tendency of Zn in the β phase.

Various methods have been proposed for improving the dezincing resistance of brass containing lead. For example, Patent Reference 1 listed below teaches improvement of dezincing resistance by adding Sn to Cu—Zn alloy and further controlling γ phase ratio and Sn concentration in the γ phase through various heat treatments after hot extrusion, and Patent Reference 2 teaches improvement of dezincing resistance by adding Sn and Si at certain rates to Cu—Zn alloy containing Pb.

Proposals have also been made regarding obtaining a suitable degree of cuttability in free-cutting brass without Pb (with no added Pb). Patent Reference 3, for instance, teaches that cuttability and strength can be enhanced by adding Si to Cu—Zn brass and Patent Reference 4 discloses a brass-bismuth alloy containing not more than 0.1% Pb that maintains the cuttability of free-cutting brass thanks to addition of Bi. Patent Reference 5 discloses a lead-free free-cutting brass that is leadless and good in dezincing resistance.

Patent Reference 1 JP-A-Hei-10(1998)-183275

Patent Reference 2 JP-A-2002-12927

Patent Reference 3 JP-A-2000-119774

Patent Reference 4 JP-A-Sho-54(1979)-135618

Patent Reference 5 JP-A-2002-3967

As taught by the above Patent References, a leadless free-cutting brass can retain free-cuttability by addition of Bi or Si and, in fact, leadless free-cutting brasses available on the market are divided mainly into two types: Bi system and Si system. However, since leadless brasses use Pb-free starting materials, Bi-master alloy, Cu—Si-master alloy or the like, the cost of the starting materials is inevitably high. Another problem is that the fact that the brasses are divided into to two types complicates scrap sorting and distribution.

Moreover, the leadless free-cutting brass of Patent Reference 5 does not readily exhibit dezincing resistance effect unless the β phase, which is poor in dezincing resistance, is fragmented. As this makes the β phase area small at high temperature, the hot workability becomes inferior. In addition, the dezincing resistance property varies depending on the form and area ratio of the α and β phases, making it necessary to conduct heat treatment after hot working or extrusion. The leadless free-cutting brass is therefore not readily applicable to forged and other products that are not heat-treated after hot working.

An object of the present invention is to overcome the foregoing problems by providing a copper-based alloy excellent in dezincing resistance that achieves improved dezincing resistance, hot forgeability and cuttability without containing Pb and can be produced at low cost.

SUMMARY OF THE INVENTION

The present invention provides a copper-based alloy excellent in dezincing resistance comprising, in percentage by weight, Cu: 57–69%,
Sn: 0.3–3%
Si: 0.02–1.5%,
Bi: 0.5–3%, and
Pb: not more than 0.2% (including 0%), where the ratio of Si/Sn expressed in weight percentage is in the range of 0.05–1 and the apparent zinc content as defined by Formula (1) below is in the range of more than 39–50 wt. %, and optionally further containing, in percentage by weight, at least one of P: 0.02–0.2%, Sb: 0.02–0.2% and As: 0.02–0.2% at a total content of 0.02–0.2%, and/or at least one of Fe: 0.01–0.5%, Ni: 0.01–0.5%, Mn: 0.01–0.5%, Al: 0.01–0.5%, Cr: 0.01–0.5%, Be: 0.01–0.5%, Zr: 0.01–0.5%, Ce: 0.01–0.5%, Ag: 0.01–0.5%, Ti: 0.01–0.5%, Mg: 0.01–0.5%, Co: 0.01–0.5%, Te: 0.01–0.2%, Au: 0.01–0.5%, Y: 0.01–0.5%, La: 0.01–0.5%, Cd: 0.01–0.2%, Ca: 0.01–0.5% and B: 0.01–0.5% at a total content of 0.01–3%, and balance of unavoidable impurities:

$$\text{Apparent Zn content}=[(\text{Zn }\%+2.0\times\text{Sn }\%+10.0\times\text{Si }\%)/(\text{Cu }\%+\text{Zn }\%+2.0\times\text{Sn }\%+10.0\times\text{Si }\%)]\times 100 \quad (1).$$

Alloys according to the present invention can be produced by using one of both of Si-system leadless brass scrap as source starting material for Si and Bi-system leadless brass scrap as source starting material for Bi.

DESCRIPTION OF THE PREFERRED EMBODIMENTS

First, a general explanation will be given regarding the reasons for the particulars specified by the present invention, namely, the reasons for defining the individual alloy elements of the invention alloy and their content ranges.

Cu: As the Cu content of the brass increases, α phase increases to enhance corrosion resistance, but when the Cu content exceeds 69 wt %, the hot forgeability declines abruptly. As Cu is more costly than Zn, moreover, Cu content is preferably held as low as possible in the interest of economy. On the other hand, β phase increases when the Cu content falls below 57 wt %. Although the hot-working forgeability of β phase is better than that of α phase, it is hard and brittle at ordinary temperatures and also very poor in dezincing resistance. It therefore becomes necessary to add large amounts of elements that contribute to dezincing resistance improvement at the expense of lowering the strength and ductility of the alloy. In light of these considerations, the Cu content is defined as 57–69 wt %, preferably 59–63 wt %.

Sn: Sn produces a dezincing resistance effect when present at a content of not less than 0.3 wt %. Moreover, dezincing resistance improves markedly with increasing Sn content. But a Sn content in excess of 3 wt % causes deep defects at the ingot surface during forging, while failing to produce an improvement in dezincing resistance commensurate with the amount of Sn added. Further, Sn boosts cost because it is higher priced than Zn and Cu. The Sn content is therefore defined as 0.3–3 wt %, preferably 0.5–2 wt %.

Si: Si contributes to forgeability improvement and also helps to bring out the dezincing resistance improving effect of Sn. Of particular note is that Si improves the dezincing resistance of the β phase by preferentially entering it in solid solution. Specifically, addition of an appropriate amount of Si improves the fluidity of the melt during casting, inhibits Sn segregation, fully brings out the dezincing resistance improving effect of Sn even with no heat treatment after hot extrusion and hot forging, and enables reliable improvement of dezincing resistance and mechanical properties.

When Si content exceeds 1.5 wt %, however, γ phase formed of Si and Cu precipitates at the grain boundaries of the α phase to become a cause of brittleness, while declines in forgeability and hot workability occur owing to the presence of a large amount of Si oxide. When the Si content exceeds 1.8 wt %, the heat conductivity of the alloy falls markedly. This gives rise to a number of problems, including that blade temperature rises during cutting, blade service life is shortened, cutting precision is degraded and cutting speed cannot be increased. When the Si content is lower than 0.02 wt %, however, the aforesaid forgeability improving effect and Sn segregation inhibiting effect cannot be obtained. In light of the foregoing, the Si content is defined as 0.02–1.5 wt %, preferably 0.06–0.7 wt %.

Si/Sn ratio: The reason for defining Si/Sn ratio in the present invention is that in order to bring out the dezincing resistance improving effect of Sn to the maximum it is necessary to select an amount of Si addition appropriate for the amount of Sn addition. Brass with an Si/Sn ratio of 60/40 generally has a two-phase structure of α+β phase and is characterized by the β phase being inferior to the α phase in dezincing resistance. Although Sn improves dezincing resistance by dissolving in solid solution more into β phase than α phase, γ phase precipitate is observed when Sn is added to 0.5 wt %. Being hard and brittle in nature, γ phase not only degrades the brittleness property of the untreated raw alloy but also dissolves much Sn in solid solution to inhibit dezincing resistance effect of Sn on the α and β phases constituting the matrix. On the other hand, the zinc equivalent of Si is 10, a large value that enables Si addition to be utilized for reducing γ phase precipitation and increasing the proportion of the β phase. By appropriately controlling the Si/Sn ratio, therefore, is possible to obtain the dezincing resistance effect of Sn while leaving the α+β phase unchanged. Another effect of Si addition is to inhibit Sn segregation by promoting long growth of slender secondary dendrite branches during solidification.

When Si/Sn is greater than 1, β phase volume increases to produce a relative lowering of the Sn concentration of the β phase that makes it difficult to achieve a sufficient dezincing resistance effect. Moreover, owing to the low molecular weight and strong solid-solution hardening effect of Si, addition of Si in a larger amount than Sn leads to ordinary temperature brittleness. On the other hand, when Si/Sn is smaller than 0.05, Sn segregation inhibiting effect is not sufficiently exhibited and, in addition, the alloy tends to assume an α+β+γ three phase structure that makes a dezincing resistance effect hard to realize. The Si/Sn ratio is therefore defined as 0.05–1, preferably 0.1–0.5.

Bi: Bi has properties closely resembling those of Pb as regards melting point and solid solubility in Cu—Zn. It therefore helps to improve the cuttability of the alloy. Sufficient cuttability cannot be achieved in leadless brass at a Bi content smaller than 0.5 wt %, while a content in excess of 3 wt % degrades extrusion, forging and other hot-working properties. The Bi content is therefore defined as 0.5–3 wt %, preferably 1.2–2.3 wt %.

Such use of Bi in place of Pb and use of Si to improve dezincing resistance makes it possible to utilize either Bi-system leadless scrap or Si-system leadless scrap for producing the invention alloy. Moreover, Sn-plated brass sheet scrap, which contains a large amount of Sn, can also be used. The cost advantage of this is very considerable.

P, Sb, As: These elements help to inhibit dezincing corrosion with no harmful effect on cuttability and forgeability. No dezincing control effect is observed, however, when these elements are present at a content smaller than 0.02 wt %. On the other hand, when the content of these elements exceeds 0.2 wt %, grain boundary segregation arises, ductility decreases and susceptibility to stress corrosion cracking increases. Therefore, the content of each of P, Sb and As is defined as 0.02–0.2 wt %, and the total content when two or more of the elements are added is defined as 0.02–0.2 wt %.

Pb: Although the present invention does not call for addition of Pb, unavoidable incorporation of Pb occurring in the course of production for the alloy can be tolerated up to a content of 0.2 wt %. When the invention alloy has a Pb content of not greater than 0.2 wt %, its Pb elution rate clears the standard of not greater than 0.01 mg/L set under the leach performance test method for water equipment (terminal water equipment) of JIS 3200 (1997). The content of Pb incorporated as impurity is therefore defined as not greater than 0.2 wt %.

The alloy according to the present invention can further include one or more of, in percentage by weight, Fe: 0.01–0.5%, Ni: 0.01–0.5%, Mn: 0.01–0.5%, Al: 0.01–0.5%, Cr: 0.01–0.5%, Be: 0.01–0.5%, Zr: 0.01–0.5%, Ce: 0.01–0.5%, Ag: 0.01–0.5%, Ti: 0.01–0.5%, Mg: 0.01–0.5%, Co: 0.01–0.5%, Te: 0.01–0.2%, Au: 0.01–0.5%, Y: 0.01–0.5%, La: 0.01–0.5%, Cd: 0.01–0.2%, Ca: 0.01–0.5% and B: 0.01–0.5%. When two or more of these elements are incorporated, the total content thereof is defined as 0.01–3 wt %. Addition of these elements within the foregoing ranges enables improvement of tensile strength and hardness by solid-solution strengthening, without impairing dezincing resistance, cuttability or hot workability. The fact that the invention alloy allows incorporation of these elements is also advantageous from the viewpoint of cost because it enables utilization of various kinds of scrap as starting materials.

Apparent Zn content: When a third element is added to a Cu—Zn alloy, it generally enters the α phase and/or β phase without forming a separate phase. In such a case, the structure acts as though the Zn content were increased or decreased, and the alloy exhibits corresponding properties. This phenomenon can be expressed in terms of Zn equivalent. The value of the Zn equivalent is specific to the added element. (The Zn equivalent values of various added elements are set out, for example, in *Copper and Copper Alloy Fundamentals and Industrial Technology,* Japan Copper and Brass Association, Published Oct. 31, 1994, P226, Table 1.) However, in an alloy such as that according to the present invention, which contains only a small amount of Fe, Ni, Al and the like, if any at all, the apparent zinc content is not substantially affected by these elements. Since their addition therefore has little effect on the alloy properties, and the amount of Bi and Pb entering the matrix phase at ordinary temperatures is negligible, the effect of these elements on dezincing resistance is slight. From this it follow that they can be omitted from the calculation of the apparent zinc content with no appreciable adverse effect. In view of the fact that it is Sn and Si that have a particularly strong effect on the apparent zinc content of the invention alloy, the apparent zinc content is calculated from Formula (1) in the present invention:

$$\text{Apparent Zn content}=[(\text{Zn }\%+2.0\times\text{Sn }\%+10.0\times\text{Si }\%)/(\text{Cu }\%+\text{Zn }\%+2.0\times\text{Sn }\%+10.0\times\text{Si }\%)]\times100 \quad (1).$$

When the apparent zinc content is 39 wt % or less, hot workability is degraded because the proportion of β phase becomes low at high temperature. On the other hand, when the apparent zinc content exceeds 50 wt %, the strength of the alloy increases to make it brittle at ordinary temperatures. The apparent zinc content is therefore defined as more than 39–50 wt. %, preferably more than 39–44 wt. %.

The invention copper-based alloy having the aforesaid composition exhibits excellent dezincing resistance, hot forgeability and cuttability even though not containing Pb. Moreover, since the copper-based alloy of the present invention contains Si and Bi, it can be produced using Si-system leadless brass scrap as source starting material for Si and Bi-system leadless brass scrap as source starting material for Bi. It can therefore be produced at low cost.

EXAMPLES

Example 1

Table 1 shows the chemical compositions (in wt %) of specimen alloys. All of the specimens were obtained by melting the starting materials in an induction furnace, semi-continuously casting the melt into 80 mm-diameter billets from a temperature of around (liquidus+100° C.), holding each billet at 800° C. for 30 minutes, thereafter hot extruding the billet to a diameter of 30 mm at that temperature, and air cooling the extruded product. Test pieces required for analysis were taken at this stage. The hot-extrusion product was forged at a material temperature of 650–750° C., upset rate of 30–70% and strain rate of 15 mm/sec, followed by cooling at 0.32–5.4° C./sec.

Each alloy was evaluated for castability, cuttability, tensile strength, elongation, hardness, dezincing resistance, hot forgeability, and amount of lead elution. The results are shown in Tables 2–5. The evaluation methods used are set out below.

Forgeability: Surface defect depth at billet surface overlaps and the like were measured and surface defect depth of not greater than 1 mm was rated as Excellent (E), 1 mm-less than 3 mm as Good (G), and 3 mm or greater as Poor (P).

Tensile test: The hot-extrusion product was tested in accordance with JIS Z 2241.

Vickers hardness test: The hot-extrusion product was tested in accordance with JIS Z 2252.

Cuttability: The specimen of each alloy after hot extrusion was cut (cutter material: super hard tool steel) without use of cutting oil at a rotational speed of 950 rpm, cutting depth of 0.5 mm, feed rate of 0.06 mm/rev. and feed amount of 100 mm.

Evaluation was made on two points: chip fragmentation and cutting resistance (index of cuttability).

Chip fragmentation was rated Good (G) when the chips were totally fragmented and as Poor (P) when the chips could not be fragmented.

Cuttability index was evaluated by comparing the measured cutting force of each component with the cutting force of JIS C 3604 using the equation below. The cuttability index was rated Good (G) when 80% or higher and Poor (P) when below 80%.

Cuttability index (%)=100×(JIS C 3604 cutting force)/(cutting force during specimen cutting)

Dezincing resistance: The tested specimen was prepared by forging the hot-extrusion product at a temperature of 700° C. and upset rate of 60%, followed by air cooling at a cooling rate of 2.7° C./sec. The degree of change in dezincing resistance owing to heat treatment was investigated by evaluating the dezincing resistance of each alloy before and after heat treatment at 400° C.×3 hours. Alloy No. 1 in Table 1 was examined for effect of cooling rate after forging on dezincing resistance. The dezincing test was conducted by the method of ISO 6509 (1981). Dezincing resistance was rated Poor (P) when the maximum dezincing depth was 200 μm or greater, Good (G) when it was less than 200 μm, and Excellent (E) when it was less than 100 μm.

Hot forgeability (max. upset rate): Hot forgeability was evaluated using an upset test. The test was conducted by heating a 20 mm diameter×20 mm test piece to a prescribed temperature, forging it at an upset rate of 30–70%, and evaluating hot forgeability based on whether or not cracking was observed after the forging. Upset rate was calculated as follows:

$$\text{Upset rate }(\%)=100\times(20-h)/20.$$

Amount of lead elution: Evaluation was conducted in accordance with the leach performance test method for water equipment (terminal water equipment) of JIS 3200 (1997).

TABLE 1

| | Chemical composition (wt. %) | | | | | | | | | | | | | Apparent |
|---|---|---|---|---|---|---|---|---|---|---|---|---|---|---|
| Alloy No. | Cu | Zn | Sn | Si | Si/Sn | Bi | Pb | P | Fe | Al | Mn | Zr | Ni | zinc content |
| Invention | | | | | | | | | | | | | | |
| 1 | 62.1 | Bal | 1.23 | 0.56 | 0.455 | 1.8 | 0.02 | 0.02 | 0 | 0 | 0 | 0 | 0 | 40.5 |
| 2 | 61.5 | Bal | 1.00 | 0.65 | 0.650 | 1.2 | 0.007 | 0 | 0.01 | 0 | 0.01 | 0 | 0 | 41.8 |
| 3 | 61.1 | Bal | 1.43 | 0.75 | 0.524 | 2.3 | 0.11 | 0.07 | 0 | 0 | 0 | 0 | 0 | 42.2 |
| 4 | 59.8 | Bal | 2.12 | 0.24 | 0.113 | 2.8 | 0.04 | 0 | 0 | 0 | 0 | 0 | 0.05 | 41.0 |
| 5 | 59.6 | Bal | 1.08 | 0.20 | 0.185 | 1.6 | 0.02 | 0.05 | 0.11 | 0.02 | 0 | 0 | 0.09 | 41.0 |
| 6 | 58.4 | Bal | 2.99 | 1.30 | 0.435 | 1.4 | 0.014 | 0.05 | 0.13 | 0 | 0.04 | 0.08 | 0.17 | 48.2 |
| 7 | 63.3 | Bal | 0.96 | 0.61 | 0.635 | 1.7 | 0.002 | 0.05 | 0.1 | 0.11 | 0 | 0 | 0.3 | 39.2 |
| 8 | 61.2 | Bal | 1.16 | 0.18 | 0.155 | 1.8 | 0.009 | 0.04 | 0.17 | 0 | 0 | 0 | 0 | 39.2 |

TABLE 1-continued

| Alloy No. | Chemical composition (wt. %) Cu | Zn | Sn | Si | Si/Sn | Bi | Pb | P | Fe | Al | Mn | Zr | Ni | Apparent zinc content |
|---|---|---|---|---|---|---|---|---|---|---|---|---|---|---|
| 9 | 58.7 | Bal | 1.50 | 0.36 | 0.240 | 2.1 | 0.0008 | 0.08 | 0.25 | 0.04 | 0 | 0 | 0.24 | 42.5 |
| 10 | 60.2 | Bal | 1.10 | 0.45 | 0.409 | 1.8 | 0.17 | 0.03 | 0.23 | 0 | 0 | 0 | 0.37 | 41.3 |
| Comparative | | | | | | | | | | | | | | |
| 11 | 59.7 | Bal | 0.22 | 0 | 0 | 0 | 1.9 | 0 | 0.31 | 0 | 0 | 0 | 0 | 39.1 |
| 12 | 60.3 | Bal | 0.30 | 0.00 | 0.000 | 1.79 | 0.11 | 0 | 0.11 | 0 | 0 | 0 | 0 | 38.7 |
| 13 | 60.9 | Bal | 0.78 | 0.00 | 0.000 | 0 | 0.07 | 0.04 | 0 | 0 | 0 | 0 | 0 | 39.5 |
| 14 | 63.8 | Bal | 0.11 | 0.78 | 7.091 | 1.8 | 0.07 | 0 | 0.11 | 0 | 0 | 0 | 0 | 39.3 |
| 15 | 60.7 | Bal | 0 | 3 | 0 | 2.1 | 0.022 | 0 | 0.24 | 0 | 0 | 0 | 0 | 51.3 |
| 16 | 61.5 | Bal | 0.89 | 1.9 | 2.135 | 2.6 | 0.011 | 0 | 0 | 0 | 0 | 0 | 0 | 46.7 |

TABLE 2

| Alloy No. | Forgeability | Tensile strength Mpa | Elongation % | Hardness Hv | Dezincing resistance Before heat treatment | After heat treatment | Chip Fragmentation | Cuttability index |
|---|---|---|---|---|---|---|---|---|
| Invention | | | | | | | | |
| 1 | E | 484 | 16 | 135 | E | E | G | G |
| 2 | E | 462 | 28 | 122 | G | G | G | G |
| 3 | E | 492 | 15 | 148 | E | E | G | G |
| 4 | E | 496 | 18 | 151 | G | G | G | G |
| 5 | E | 481 | 23 | 129 | E | E | G | G |
| 6 | E | 449 | 30 | 120 | E | E | G | G |
| 7 | E | 432 | 31 | 121 | G | G | G | G |
| 8 | E | 460 | 24 | 130 | G | G | G | G |
| 9 | E | 501 | 19 | 161 | E | E | G | G |
| 10 | E | 458 | 25 | 131 | G | G | G | G |
| Comparative | | | | | | | | |
| 11 | E | 389 | 48 | 106 | P | P | G | G |
| 12 | E | 388 | 30 | 125 | P | P | G | G |
| 13 | G | 438 | 21 | 128 | P | G | P | P |
| 14 | G | 462 | 15 | 133 | P | G | G | P |
| 15 | G | 511 | 8 | 166 | G | G | G | P |
| 16 | P | 522 | 7 | 168 | P | P | G | P |

TABLE 3

| Example No. | Maximum upset rate (%) Forging temperature (° C.) 630 | 670 | 710 | 750 |
|---|---|---|---|---|
| Exmp. 1 | 60 | 70 | 70 | 60 |
| Exmp. 6 | 70 | 70 | 70 | 70 |
| Exmp. 10 | 60 | 70 | 70 | 70 |
| Comp. Exmp. 11 | 60 | 70 | 70 | 60 |
| Comp. Exmp. 16 | 40 | 40 | 50 | 50 |

TABLE 4

| Example No. | Maximum dezincing depth (μm) Cooling rate (° C./sec) 0.32 | 0.76 | 2.7 | 5.4 |
|---|---|---|---|---|
| Example 1 | 60 | 66 | 51 | 43 |

TABLE 5

| Example No. | Amount Of lead elution (mg/L) |
|---|---|
| Exmp. 1 | 0.0036 |
| Exmp. 7 | 0.0008 |
| Comp. Exmp. 11 | 0.0468 |

As can be seen from Table 2, Comparative Example 11 (corresponding to the JIS C 3771 hot-forging alloy) had good cuttability because it contained Pb. However, since it did not contain Si and Bi and was also low in Sn, it was inferior in dezincing resistance and poor in mechanical properties. Comparative Example 12 had a lower Pb content than Comparative Example 11, but since it contained no Si and was also low in apparent Zn content, it was inferior in dezincing resistance and also poor in mechanical properties. Comparative Example 13 contained no Pb, Si and Bi and was therefore poor in cuttability. Comparative Example 14 was poor in dezincing resistance and cuttability index owing to its excessively high Sn/Si ratio. Comparative Example 15 was too high in Si content, contained no Sn and had a high apparent Zn content. It was therefore low in elongation and poor in cuttability index. The poor forgeability, elongation, dezincing resistance and cuttability index of Comparative Example 16 was due to its excessively high Si content and high Si/Sn ratio. In contrast, the alloys of Examples 1–10 according to the present invention were excellent in cuttability and also in good forgeability, mechanical properties and dezincing resistance despite containing no added Pb.

The invention alloys exhibited no change in dezincing resistance between before and after heat treatment and had adequate dezincing resistance even though not subjected to heat treatment after hot working or hot forging. This can be considered to be because the Si added to the invention alloys maintained the proportion of the β phase under high and ordinary temperatures at 20% or higher, and the dezincing resistance was strengthened by dissolving Sn and Si into this β phase in solid solution. Excellent dezincing resistance could therefore be reliably obtained insofar as the cooling after hot working and hot forging was within the range of ordinary air-cooling and no special heat treatment was necessary. In contrast, Comparative Examples 11 and 12 were poor in dezincing resistance because they did not contain Si, and Comparative Examples 13 and 14 experienced a marked difference in maximum dezincing depth between before and after heat treatment. Table 4 shows the dezincing depth experienced by the alloy No. 1 when specimens of the alloy were cooled at various different cooling rates following forging at 700° C. As can be seen from Table 4, changing the cooling rate did not cause marked change in the structure of the invention alloy and substantially the same dezincing resistance could be obtained irrespective of cooling rate.

Further, as can be seen from Table 3, the invention alloyes had good forgeability comparable to that of the hot-forging alloy of JIS C 3771 on Example 11, and as can be seen from Table 5, Pb elution rate of the invention alloys cleared the stipulated standard of not greater than 0.01 mg/L.

Thus, as set out in the foregoing, the present invention offers a dezincing resistant copper-based alloy that achieves excellent in forgeability, dezincing resistance, hot forgeability and cuttability without addition of Pb. In addition, the alloy has the advantage of being producible at low cost because it can be manufactured using both Bi-system leadless brass scrap and Si-system leadless brass scrap as starting materials.

What is claimed is:

1. A copper-based alloy excellent in dezincing resistance consisting essentially of, in percentage by weight:

Cu: 57–69%,

Sn: 0.3–3%

Si: 0.02–1.5%,

Bi: 0.5–3%, and

Pb: not more than 0.2% (including 0%),

P: 0.02–0.2%. and the balance: Zn and unavoidable impurities, further containing, in percentage by weight, where the ratio of Si/Sn expressed in weight percentage is in the range of 0.05–and apparent zinc content as defined by Formula (1) below is in the range of more than 39–50 wt. %, $$\text{Apparent Zn content}=[(\text{Zn }\% +2.0\times\text{Sn }\% +10.0\times\text{Si }\%)/(\text{Cu }\% +\text{Zn }\% +2.0\times\text{Sn }\% +10.0\times\text{Si }\%)]\times 100 \quad (1).$$

2. A copper-based alloy excellent in dezincing resistance according to claim 1, wherein one or both of Si-system leadless brass scrap and Bi-system leadless brass scrap are used as source starting material for Si and Bi, respectively.

3. A copper-based alloy excellent in dezincing resistance consisting essentially of, in percentage by weight Cu: 57–69%, Sn: 0.3–3%

Si: 0.02–1.5%,

Bi: 0.5–3%,

Pb: not more than 0.2% (including 0%),

P: 0.02–0.2%, at least one of Fe: 0.01–0.5%, Ni: 0.01–0.5%, Mn 0.01–0.5%, Al 0.01–0.5%, Cr: 0.01–0.5%, Be: 0.01–0.5%, Zr: 0.01–0.5%, Ce: 0.01–0.5%, Ag: 0.01–0.5%, Ti: 0.01–0.5%, Mg: 0.01–0.5%, Co: 0.01–0.5%, Te: 0.01–0.2%, Au: 0.01–0.5%, Y: 0.01–0.5%, La: 0.01–0.5%, Cd: 0.01–0.2%, Ca: 0.01–0.5% and B: 0.01–0.5% at a total content of 0.01–3% and the balance: Zn and unavoidable impurities.

where the ratio of SVSn expressed in weight percentage is in the range of 0.05–1 and apparent zinc content as defined by Formula (1) below is in the range of more than 39–50 wt. %, $$\text{Apparent Zn content}=[(\text{Zn }\% +2.0\times\text{Sn }\% +10.0\times\text{Si }\%)/(\text{Cu }\% +\text{Zn }\% +2.0\times\text{Sn }\% +10.0\times\text{Si }\%)]\times 100 \quad (1).$$

4. A copper-based alloy excellent in dezincing resistance according to claim 3, wherein one or both of Si-system leadless brass scrap and Bi-system leadless brass scrap are used as source starting material for Si and Bi, respectively.

* * * * *

Disclaimer

6,942,742—Yoshinori Yamagishi, Tokyo (JP) COPPER-BASED ALLOY EXCELLENT IN DEZINCING RESISTANCE. Patent dated Sep. 13, 2005. Disclaimers filed Jan. 11, 2006, by the assignee, Dowa Mining Co., Ltd.

The term of this patent shall not extend beyond the expiration date of Pat. No. 6,942,742.

*Official Gazette, March 21, 2006*